United States Patent [19]

Headrick et al.

[11] 4,039,189

[45] Aug. 2, 1977

[54] FLYING DISC ENTRAPMENT DEVICE

[76] Inventors: Edward E. Headrick; Kenneth A. Headrick, both of 4900 Crown Ave., La Canada, Calif. 91011

[21] Appl. No.: 678,125

[22] Filed: Apr. 19, 1976

[51] Int. Cl.[2] ..... A63B 67/06

[52] U.S. Cl. ..... 273/105 R

[58] Field of Search ..... 273/105, 102.4, 102 R, 273/102 S, 127 R

[56] References Cited

U.S. PATENT DOCUMENTS

| | | | |
|---|---|---|---|
| 868,950 | 4/1907 | Vasey | 273/105 R |
| 1,169,966 | 11/1915 | Kenstowicz | 273/102 R |
| 2,126,245 | 8/1938 | Darby | 273/105 R |
| 2,321,835 | 6/1943 | Marlow | 273/102 R |
| 2,811,358 | 10/1957 | Ruth | 273/102 R |
| 3,338,579 | 8/1967 | McKain | 273/127 R |
| 3,421,764 | 1/1969 | Smith et al. | 273/105 R |
| 3,455,554 | 7/1969 | Rademacher | 273/102.4 |
| 3,540,734 | 11/1970 | Temple | 273/105 R |

FOREIGN PATENT DOCUMENTS

| | | | |
|---|---|---|---|
| 1,142,043 | 1957 | France | 273/105 R |
| 2,152,251 | 1973 | Germany | 273/29 A |
| 223,425 | 1924 | United Kingdom | 273/95 R |

*Primary Examiner*—Richard C. Pinkham
*Assistant Examiner*—Lawrence E. Anderson
*Attorney, Agent, or Firm*—Keith D. Beecher

[57] ABSTRACT

An entrapment device is provided for use in a flying disc golf game, or the like, and which provides a structure for absorbing the kinetic energy of flying discs thrown at the device to arrest the forward motion of the discs, and to cause the discs to be caught by the device. The device in one of its embodiments constitutes a post mounted in the ground, a basket mounted on the post, and energy absorbing structure mounted on the post above the basket. When the flying disc is thrown in the direction of the post, so as to strike the energy absorption structure, the energy absorption structure acts as a cushion for the disc thereby arresting its forward motion, and it causes the disc to drop into the basket.

3 Claims, 4 Drawing Figures

FLYING DISC ENTRAPMENT DEVICE

BACKGROUND OF THE INVENTION

Flying discs which can be thrown in a manner such that they can be controlled to describe a variety of arcuate paths while in flight are well known to the art.

Flying disc golf games have recently been conceived which are played on courses appropriately laid out in parks or other recreational areas. The flying disc golf course comprises a number of "holes", each comprising a "tee" from which a flying disc is originally thrown by each player, and each comprising a post displaced a selected distance from the tee. In playing each hole, the flying disc is first thrown from the tee in the direction of the post, and around predetermined obstacles, such as trees. The disc is then picked up by the player at the point at which it landed, and is again thrown in the direction of the post. This process is repeated until the post is struck by the disc, and the number of throws required to attain this objective are tabulated. Obviously, the object of the game is to strike the post for each hole with the least number of throws.

A problem has arisen in the prior art flying disc golf courses in detecting as a certainty whether or not a disc has actually struck the post for any particular throw, especially when the disc has been thrown in the direction of the post from a considerably distance.

The aforesaid problem is solved by the device of the present invention, which provides an energy absorbing means on the post which serves to arrest the forward motion of the disc, and which also provides an entrapment means in which the disc is deposited. By use of the device of the present invention, any disc properly thrown against the post is caught, and all prior ambiguities are obviated.

DETAILED DESCRIPTION OF THE ILLUSTRATED EMBODIMENTS

Figure 1:
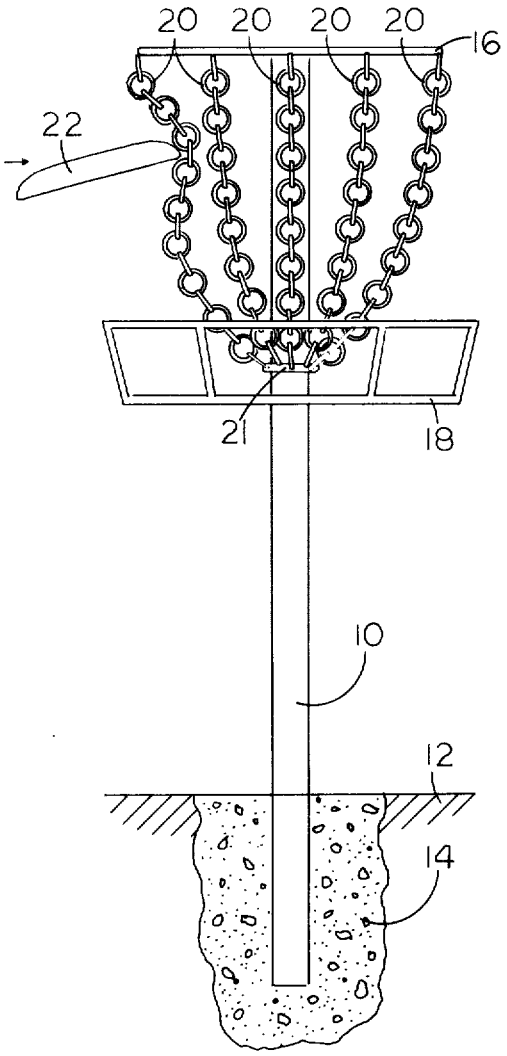
FIG. 1 is an elevational view of a flying disc entrapment device in accordance with one embodiment of the invention, and showing a disc being "caught" by the device.
Figure 2:
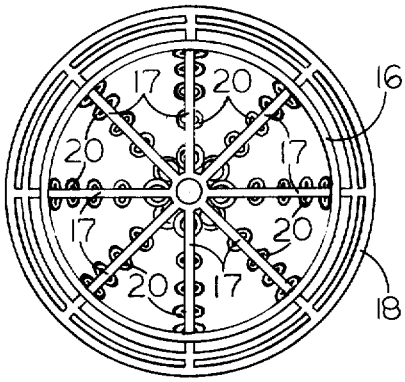
FIG. 2 is a top plan view of the device of FIG. 1.

In the embodiment of FIGS. 1 and 2, a post 10 is mounted in an upright position in the ground 12 by means, for example, of a concrete base 14. An annular bracket 16 is mounted on the upper end of post 10 by means of a plurality of radial support rods 17 (FIG. 2), and an annular open-topped basket 18 is mounted on the post under the bracket 16. A plurality of chains 20 are mounted with their upper ends attached to the bracket 16 at spaced annular positions around its periphery. The lower ends of chains 20 are attached to a loose collar 21 which is mounted on post 10 within the confines of basket 18.

Figure 4:
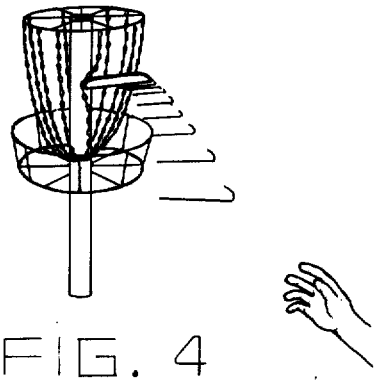
FIG. 4 is a second elevational view of the embodiment of FIG. 1, showing a disc thrown at the device from another angle.
Figure 3:
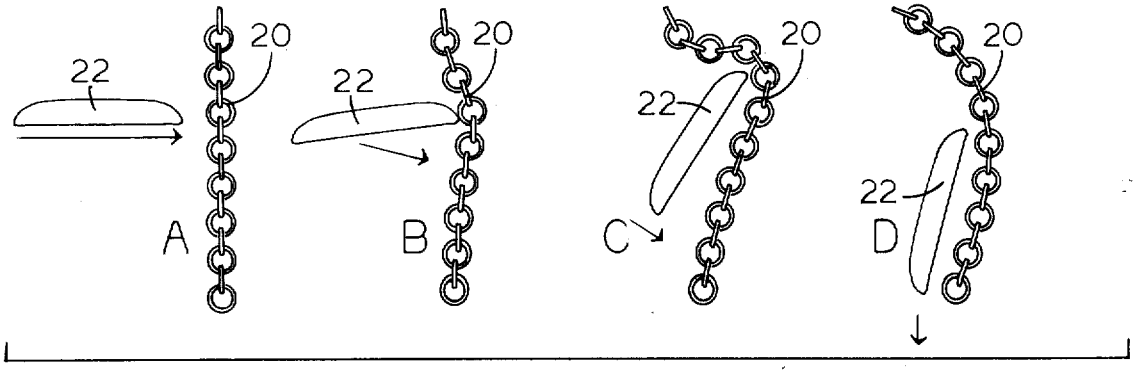
FIG. 3 is a schematic representation showing the manner in which the entrapment device of FIG. 1 absorbs the kinetic energy of a flying disc thrown against the device, thereby arresting the forward motion of the disc, and causing the disc to be deposited in the device.

As shown in FIG. 3, when a flying disc 22 (FIG. 3A) is thrown against the chains 20 (FIG. 3B), the chains serve to absorb the kinetic energy of the disc, thereby arresting its forward motion. In the process, the disc is tilted downwardly (FIG. 3C), and is caused to fall (FIG. 3D) into the basket 18. FIG. 4, as mentioned above, shows the disc thrown into the chains from another view.

With the embodiment of FIG. 1, flying discs 22 properly thrown against the chains 20 on post 10 are caught by the assembly and deposited in the basket 18.

It will be appreciated that although a particular embodiment of the invention has been illustrated and described herein, modifications may be made. It is intended in the claims to cover the modifications which come within the true spirit and scope of the invention.

What is claimed is:

1. An entrapment assembly for use in a flying disc game for arresting and trapping flying discs thrown against the assembly, said assembly including an upright post; an entrapment means mounted on the post for arresting and traping flying discs thrown thereagainst, said entrapment means including an upwardly opening basket for receiving and retaining flying discs thrown against said entrapment means said port being directly connected to said basket, and a plurality of chains mounted on said post above said basket and extending into the open top of the basket for absorbing the kinetic energy of the disc and causing the disc to be deposited in the basket.

2. The entrapment assembly defined in claim 1, in which said basket has an annular shape, and which includes an annular support bracket mounted on the upper end of the post above the basket, and upper ends of said chains being attached to said support bracket at spaced annular positions around the periphery thereof.

3. The entrapment assembly defined in claim 2, and which includes a collar mounted on said post within said basket and serving as a mount for the lower ends of the chains.

* * * * *